United States Patent [19]

Matsuoka et al.

[11] Patent Number: 4,610,945

[45] Date of Patent: Sep. 9, 1986

[54] ENCAPSULATED TONER HAVING IMPROVED IMAGE-FORMING CHARACTERISTICS

[75] Inventors: Katsumi Matsuoka; Takeshi Mikami, both of Fujinomiya, Japan

[73] Assignee: Fuji Photo Film Co., Ltd., Kanagawa, Japan

[21] Appl. No.: 681,860

[22] Filed: Dec. 14, 1984

[30] Foreign Application Priority Data

Dec. 15, 1983 [JP] Japan ..... 58-236766

[51] Int. Cl.[4] ..... G03G 9/08; G03C 1/08; G03C 1/10

[52] U.S. Cl. ..... 430/138; 427/222; 427/213.36; 428/402.24; 430/109; 430/546; 430/631; 430/634; 430/636

[58] Field of Search ..... 430/138, 109, 546, 631, 430/634, 636; 428/402.24; 427/213.36, 222

[56] References Cited

U.S. PATENT DOCUMENTS

| | | | |
|---|---|---|---|
| 3,429,827 | 2/1969 | Russ | 427/213.34 |
| 3,694,359 | 7/1972 | Merill et al. | 430/109 X |
| 3,740,334 | 6/1973 | Jacknow et al. | 430/109 X |
| 3,887,377 | 6/1975 | Yamamoto et al. | 430/631 X |
| 4,198,478 | 4/1980 | Yoneyama et al. | 430/223 X |
| 4,307,169 | 12/1981 | Matkan | 430/138 X |
| 4,410,624 | 10/1983 | Plaschnick et al. | 430/546 X |

FOREIGN PATENT DOCUMENTS

| | | | |
|---|---|---|---|
| 2337392 | 10/1972 | Fed. Rep. of Germany | 430/636 |
| 2082788 | 3/1982 | United Kingdom | 430/109 |

*Primary Examiner*—John E. Kittle
*Assistant Examiner*—Mukund J. Shah
*Attorney, Agent, or Firm*—Toren, McGeady, Stanger, Goldberg & Kiel

[57] ABSTRACT

An encapsulated toner for use in electrostatography which comprises a shell and a core material comprising a colorant, a binder and a surface active polymer containing at least 5 mol % of a unit having the formula (I):

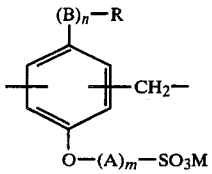

(I)

wherein R is an aliphatic hydrocarbon group having 4 to 22 carbon atoms, A is a divalent aliphatic group having 1 to 50 carbon atoms, B is —O— or NH—, M is a cation or a cationic radical capable of forming a salt with a sulfonic acid, and m and n are independently 0 or 1. A process for preparing the encapsulated toner which comprises forming a shell around a core material comprising a colorant and a binder in an aqueous medium, characterized in that said core material contains a surface active polymer containing at least 5 mol % of a unit having the above formula (I).

8 Claims, No Drawings

ENCAPSULATED TONER HAVING IMPROVED IMAGE-FORMING CHARACTERISTICS

BACKGROUND OF THE INVENTION

The present invention relates to an encapsulated toner employable for producing a visible image from a latent image formed in such a recording process as electrostatography and a process for preparing said toner. More particularly, the invention relates to an encapsulated toner having improved image-forming characteristics and a process for preparing the same.

DESCRIPTION OF PRIOR ARTS

As processes for fixation of a toner image in a recording process such as electrostatography, there are known three fixation processes, namely, a heat fixing process (fusion process), a solvent fixing process and a pressure fixing process. The pressure fixing process involving the use of neither a heating procedure nor a solvent produces no such troubles as inherently attached to the heat fixing process and the solvent fixing process. Moreover, the pressure fixing process can be used in combination with a high speed automatic copying and duplicating process, and the access time is very short in the pressure fixing process. Accordingly, the pressure fixing process is thought to be an advantageous fixing process inherently having a variety of preferable features. The present invention provides an encapsulated toner suitably employable for the above-mentioned pressure fixing process.

The pressure fixing process, however, has inadvantageous features, as well as the above-stated advantageous features. For instance, the pressure fixing process generally provides poorer fixablity than the heat fixing process does, whereby the toner image fixed onto a paper sheet is apt to rub off easily. Further, the pressure fixing process requires very high pressure for the fixation, and such a high pressure tends to break the fibers of the support medium such as paper sheet and also produces glossy surface on the support medium. Furthermore, the pressing roller is required to have relatively greater size, because the roller necessarily imparts very high pressure to the toner image on the support medium. Thus, size reduction of a copying and duplicating machine cannot exceed a certain limit defined by the size of a pressing roller.

There has been previously proposed an encapsulated toner which comprises toner particles enclosed with microcapsules, so as to overcome the above-described disadvantageous features of the pressure fixing process. The encapsulated toner is prepared by enclosing a core material (containing a colorant such as carbon black and a binder such as a polymer or a high boiling point solvent) with a shell which is rupturable by the application of pressure in the developing stage. The so prepared encapsulated toner has various advantageous features; for instance, fixation of the encapsulated toner does not require very high pressure, but the fixability is high. Accordingly, the encapsulated toner is viewed as suitable for the use in the pressure fixing process. However, the encapsulated toners proposed up to now appear unsatisfactory in practical use, because they fail to meet certain requirements for providing smooth copying and duplicating operation and satisfactory toner image fixability and quality.

More in detail, it is required for the toner to be used as a developing agent in the electrostatography to have excellent powder characteristics (powder flowability) to give high development quality, and to be free from staining the surface of a photosensitive material on which a latent image is formed. Further, a toner for the use as a developing agent in the pressure fixing process is required to be satisfactory in the fixability under pressure and not to undergo off-setting on the roller surface, that is, phenomenon that the toner adheres to the roller surface so as to stain it.

In summary, the toner employed in the pressure fixing process is preferably at a high level in all characteristics such as powder characteristics (powder flowablity), fixability onto a support medium (e.g., paper sheet), as well as the preservability of the fixed image, resistance to the off-setting, and electron chargeability or electroconductivity depending on the system adopted. The previously known encapsulated toners are unsatisfactory in certain characteristics.

SUMMARY OF THE INVENTION

It is an object of the present invention to provide an encapsulated toner having improved characteristics, particularly image-forming characteristics.

It is another object of the present invention to provide a process for preparing an encapsulated toner having improved characteristics, particularly image-forming characteristics.

The present invention provides in one aspect an encapsulated toner which comprises a shell and a core material comprising a colorant, a binder and a surface active polymer containing at least 5 mol % of a unit having the following formula (I):

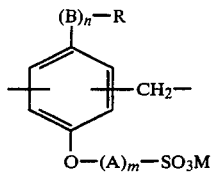

(I)

wherein R is an aliphatic hydrocarbon group having from 4 to 22 carbon atoms, A is a divalent aliphatic group having from 1 to 50 carbon atoms, B is —O— or NH—, M is a cation or a cationic radical capable of forming a salt with a sulfonic acid, and m and n are independently 0 or 1.

The present invention provides in another aspect a process for preparing an encapsulated toner which comprises forming a shell around a core material comprising a colorant and a binder in an aqueous medium to produce microcapsules which are then separated and dried, said core material being dispersed in the form of oil-droplets in said aqueous medium, characterized in that a surface active polymer containing at least 5 mol % of a unit having the above-described formula (I) is incorporated in said core material in the form of oil-droplets.

DETAILED DESCRIPTION OF THE INVENTION

As described hereinbefore, there is already known an encapsulated toner which is prepared by enclosing a core material comprising a colorant such as carbon black, a polymer and a binder such as oily medium with a resin shell being rupturable by the application of pressure thereto.

The encapsulated toner of the present invention can be obtained by forming a shell over the core material in an aqueous medium by any of conventional methods for preparing micro-capsules including interfacial polymerization method and outer polymerization method, particularly a method involving polymerization reaction; separating the resulting microcapsule from the medium; and drying it.

Examples of polymers which can be used as the binder component of the encapsulated toner of the invention include polyolefin, olefin copolymer, styrene resin, styrene-butadiene copolymer, epoxy resin, polyester, rubbers, polyvinyl pyrrolidone, polyamide, cumaroneindene copolymer, methyl vinyl ether-maleic anhydride copolymer, amino resin, polyurethane, polyurea, homopolymer and copolymer of acrylic acid ester, homopolymer and copolymer of methacrylic acid ester, acrylic acid-long chain alkyl methacrylate copolymer oligomer, polyvinyl acetate, and polyvinyl chloride.

Among them, homopolymer and copolymer of acrylic acid ester, homopolymer and copolymer of methacrylic acid ester and styrene-butadiene copolymer are particularly preferred.

The oily medium which can be used as a component for the binder are a high-boiling solvent boiling at 150° C. or higher and capable of dissolving or swelling the above polymers and include phthalates such as diethyl phthalate and dibutyl phthalate; aliphatic dicarboxylates such as diethyl malonate and dimethyl oxalate; phosphates such as tricresyl phosphate and trixylenyl phosphate; citrates such as o-acetyl triethyl citrate and tributyl citrate; benzoates such as butyl benzoate and hexyl benzoate; aliphatic acid esters such as hexadecyl myristate and dioctyl adipate; alkylnaphthalenes such as methylnaphthalene, dimethylnaphthalene, monoisopropylnaphthalene, and diisopropylnaphthalene; alkyldiphenyl ethers such as o-, m- or p-methyldiphenyl ether; higher fatty acid amides and aromatic sulfonic acid amides such as N,N-dimethyllauroamide and N-butylbenzenesulfonamide; trimellitates such as trioctyl trimellitate; and diarylalkanes such as diarylmethanes (e.g. dimethylphenylphenylmethane) and diarylethanes (e.g. 1-phenyl-1-methylphenylethane, 1-dimethylphenyl-1-phenylethane and 1-ethylphenyl-1-phenyl-ethane.

Preferably, the binder of the present invention is a mixture comprising a polymer and a high-boiling solvent.

In the invention, the oily medium preferably comprise the polymer, the high boiling-point solvent and an organic liquid having a boiling point of 100°-250° C. which is substantially incapable of dissolving the polymer or causing the polymer to swell (hereinafter referred to simply as organic liquid).

The organic liquid may be a paraffinic hydrocarbon or a naphthenic hydrocarbon.

The aliphatic saturated hydrocarbon of paraffinic or naphthenic type is generally obtained as a mixture of various hydrocarbon distillates showing boiling points in a certain range. Examples of the organic liquid which can be incorporated in a binder include paraffinic hydrocarbon mixtures having boiling point ranges of 115°-142° C. (e.g., ISOPAR E, tradename of Exxon Chemicals), 158°-177° C. (e.g., ISOPAR G), of 174°-189° C. (e.g., ISOPAR H), of 188°-210° C. (e.g., ISOPAR L), and of 207°-258° C. (e.g., ISOPAR M) and naphthenic hydrocarbon mixtures having boiling point ranges of 162°-210° C. (e.g., SHELLSOL-D40, tradename of Shell Chemicals), of 185°-220° C. (e.g., SHELLSOL-D60) and of 195°-251° C. (e.g., SHELLSOL-D70).

The above-mentioned organic liquid preferably has a boiling point range of 140°-220° C.

There is no limitation on a ratio (ratio by weight) of the organic liquid to the high boiling-point solvent, but the ratio of the former liquid/latter solvent preferably ranges from 9/1 to 1/9.

As the colorant of the electrostatographic toner, a black toner such as carbon black and grafted carbon black is generally used and a chromatic pigment such as blue, yellow and red pigments can be also used. These conventional colorants can be used in the encapsulated toner of the invention.

Magnetizable particles may be incorporated in the core material of the encapsulated toner of the invention. Conventional magnetizable particles may be used. Examples of such magnetizable particles included magnetizable particles of metals such as cobalt, iron and nickel, their alloys and metallic compounds. When magnetizable particles with color such as black magnetite particles are used, they can serve as the colorant as well as the magnetizable particles.

The characteristic feature of the present invention resides in that preferably 0.03 to 5% by weight (more preferably 0.1 to 2% by weight) of a surface active polymer (a polymer having surface activity) is incorporated in the core material, said surface active polymer containing at least 5 mol % of a unit having the formula (I):

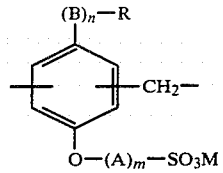

(I)

wherein R is a straight chain or branched, saturated or unsaturated aliphatic hydrocarbon group having from 4 to 22 carbon atoms, preferably 6 to 18 carbon atoms, including alkyl group such as butyl, octyl, nonyl, dodecyl and octadecyl and alkenyl group such as cis-9-octadecenyl;

A is a divalent aliphatic group having from 1 to 50 carbon atoms, including alkylene, alkyleneoxy, polyalkyleneoxy and alkyleneoxy-alkylene groups such as ethylene, trimethylene, octamethylene, ethyleneoxy, polyethyleneoxy, polypropyleneoxy and ethyleneoxytrimethylene;

B is —O— or —NH—;

M is a cation or a cationic radical capable of forming a salt with a sulfonic acid such as hydrogen, sodium, potassium, calcium, barium, ammonium and an alkylammonium having from 1 to 4 carbon atoms; and m and n may be the same or different and each is 0 or 1.

The surface active polymer of the present invention contains at least 5 mol %, preferably at least 10 mol % of the above unit having the formula (I).

Said surface active polymer may be a copolymer or a homopolymer. When the polymer is a copolymer, the copolymer containing from about 10 to 95 mol % of the unit having the formula (I) is preferred. One or more units may be incorporated in combination with the unit having the formula (I). As the unit to be incorporated therein, divalent units comprising benzene ring having methylene group or naphthalene ring having methylene group are preferred. These benzene ring and naphthalene ring have preferably at least one substituent selected from alkyl group having preferably 4 to 22 carbon atoms such as butyl, octyl, nonyl, dodecyl and octadecyl; halogen such as chlorine, bromine and iodine; hydroxyl group; alkoxy group (the alkyl potion having preferably 4 to 22 carbon atoms) such as $\beta$-chloroethoxy and $\beta$-bromoethoxy.

Examples of such units to be copolymerized include:

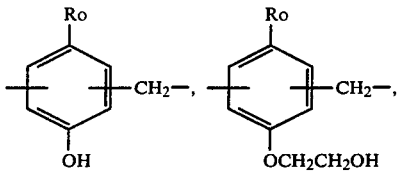

-continued

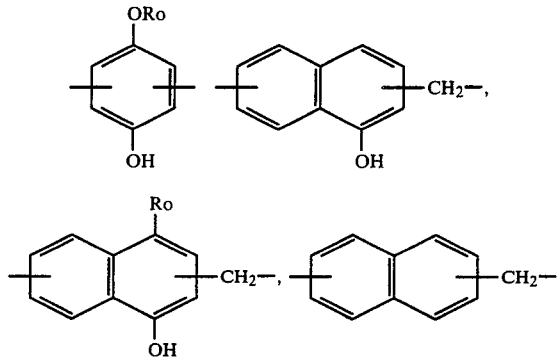

In the above formulae, Ro is an aliphatic hydrocarbon group having from 4 to 22 carbon atoms.

Although there are no limitations with regard to the molecular weight of the surface active polymer of the invention, it is desirable that the polymers have a molecular weight of about 600 to about 10,000, preferably 900 to 5,000.

Typical examples of surface active polymer which can be used in this invention (each polymer being a surface active polymer containing a unit or units specified below in the specified ratio) include:

(1)

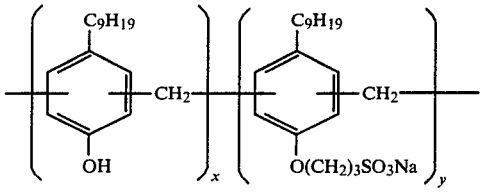

x:y = 1:1, x + y = about 6

(2)

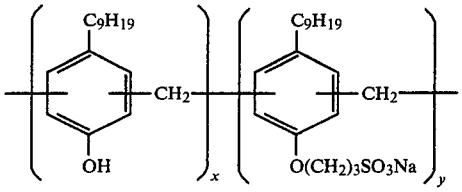

x:y = 1:4, x + y = about 6

(3)

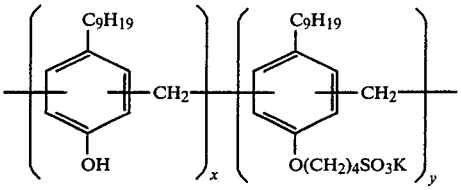

x:y = 1:9, x + y = about 6

(4)

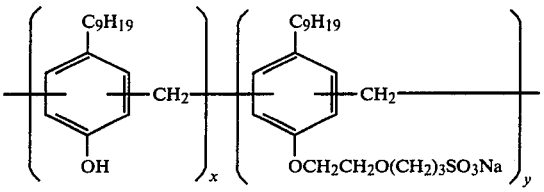

x:y = 1:1, x + y = about 6

(5)

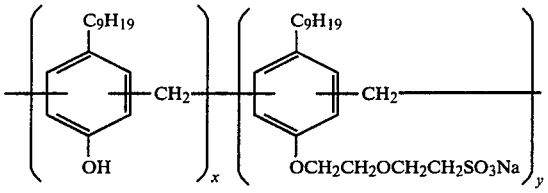

x:y = 1:4, x + y = about 10

(6)

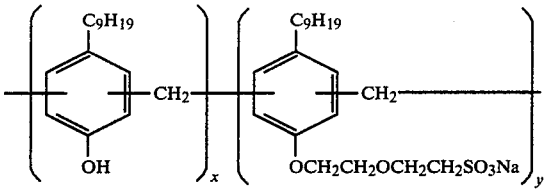

x:y = 1:4, x + y = about 25

(7)

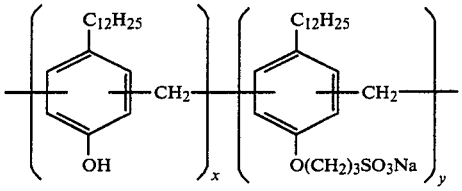

x:y = 1:9, x + y = about 10

-continued (8)

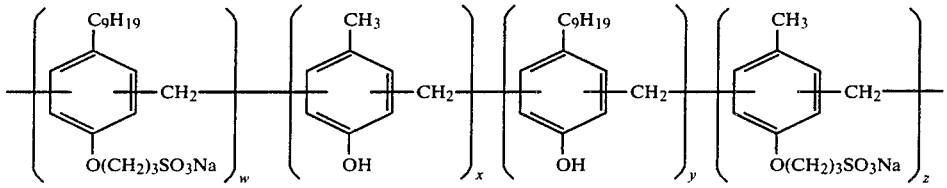

(w + z):(x + y) = 1:1 w + x + y + z = about 5

(9)

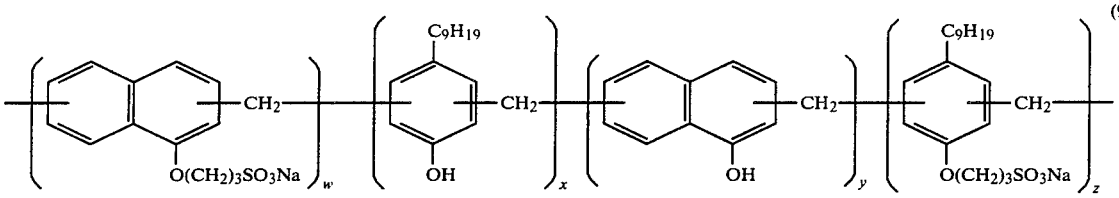

(w + z):(x + y) = 4:1 w + x + y + z = about 8

(10)

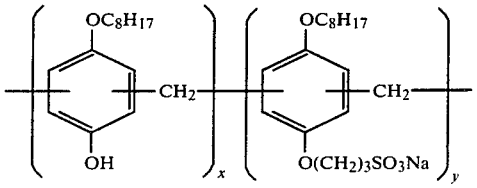

x:y = 2:3, x + y = about 8

(11)

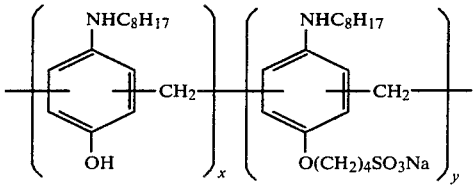

x:y = 1:1, x + y = about 4

(12)

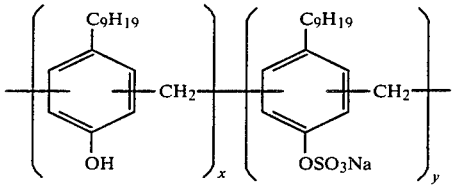

x:y = 3:2, x + y = about 6

(13)

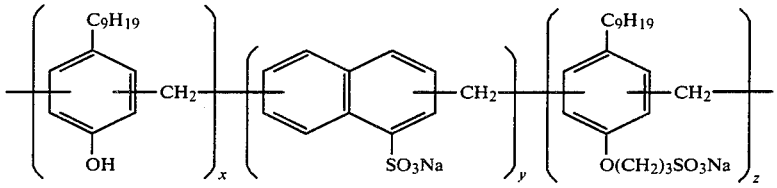

x:y:z = 4:3:3, x + y + z = about 6

(14)

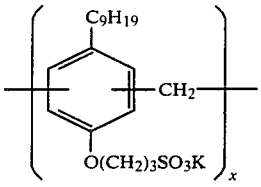

x = about 6

(15)

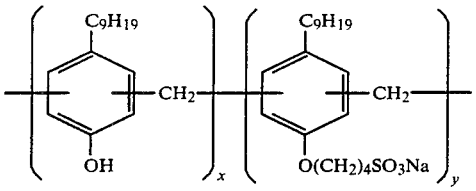

x:y = 5.5:4.5, x + y = about 6

These polymers which are used in the present invention are known and disclosed in, for instance, Japanese Patent Provisional Publication No. 53 (1978)-138726 (U.S. Pat. No. 4,198,478). The surface active polymers which are not disclosed in the specification of said Patent Provisional Publication can be prepared using general method described therein. For instance, in the first place, synthesis of polycondensates of an alkylphenol with formalin is carried out according to the methods described in "Industrial Chemistry Journal (Kogyo Kagaku Zasshi), vol. 66, page 391(1963) written in Japanese and "Oil Chemistry Journal (Yukagaku-shi)", vol. 12, page 625 (1963) written in Japanese. Thereafter, a sulfonic acid group is then introduced into the resulting reaction product according to, for instance, methods described in "Industrial Chemistry Journal", col. 73, page 563(1970) written in Japanese and J. Am. Chem. Soc., 77, 2496 (1955).

Although there are no limitations with regard to types of resins to be used for forming the shell of the encapsulated toner of the present invention, polyurea, polyurethane, polyamide and polyester are preferred from the viewpoints of the characteristics of the encapsulated toner. These resins may be used either alone or as a mixture of two or more of them. It is particularly preferred that the shell of the encapsulated toner of the invention is composed of a complex layer comprising a polyurea resin and/or polyurethane and a polyamide resin from the viewpoints of the strength and the flexibility of the shell.

Methods for preparing an encapsulated toner having a shell comprising a polyurethane resin or a polyurea resin will be described as a typical method for preparing the encapsulated toner of the present invention.

A colorant, a binder and the above-described surface active polymer (and optionally magnetic particles, a resin component constituting the shell, etc.) are first mixed together to prepare an oily solution containing a core material. The oily solution is dispersed in the form of oily droplets in an aqueous medium (e.g. an aqueous solution containing water, a resin component serving as a shell material, etc.) to form a shell around the oily droplet, thus producing microcapsules which are then separated from the aqueous medium and dried. There is already known a method for producing a microcapsule which comprises forming a shell comprising a polyurea resin and/or a polyurethane resin around a core material comprising colorant and a binder in an aqueous medium, said core material being dispersed in the form of oily droplets in said aqueous medium. This known method can be used for the preparation of the encapsulated toner of the present invention.

Methods for preparing microcapsules utilizing a polymerization reaction, which can be used in the preparation of the encapsulate toner of the present invention, include an interfacial polymerization method, an internal polymerization method and an outer polymerization method.

It is known that a shell comprising a polyurea resin and/or a polyurethane resin can be easily formed as the shell of a microcapsule by subjecting a polyisocyanate such as a diisocyanate, a triisocyanate, a tetraisocyanate or a polyisocyanate prepolymer, a polyamine such as a diamine, a triamine or a tetramine, a prepolymer containing two amino groups or piperazine or its derivative and a polyol to an interfacial polymerization in an aqueous medium.

A complex layer comprising a combination of a polyurea resin and/or a polyurethane and a polyamide is preferred as the shell of the encapsulated toner of the invention. The complex layer comprising a combination of a polyurea resin and a polyamide resin, a combination of a polyurea resin, and a polyamide resin or a combination of a polyurea resin, a polyurethane resin and a polyamide resin can be prepared in the following manner.

The complex layer comprising a combination of a polyurea resin and a polyamide resin or a combination of a polyurethane resin and a polyamide resin can be prepared, for instance, by an interfacial polymerization method wherein a polyisocyanate, an acid chloride, a polyamine and a polyol are used, the pH of an emulsifying medium serving as the reaction medium is adjusted and the reaction mixture is heated. The complex layer comprising a polyurea and a polyamide can be prepared, for instance, by using a polyisocyanate, an acid chloride and a polyamine, adjusting the pH of an emulsifying medium serving as the reaction medium and heating the reaction mixture. The methods for preparing these complex layers comprising a combination of a polyurea and a polyamide and a combination of a polyurethan resin and a polyamide are disclosed in detail in Japanese Patent Provisional Publication No. 58(1983)-66948. The shell composed of such a complex layer is suitable for use in forming an encapsulated toner wherein magnetizable particles are contained in a core material.

The microcapsules prepared by forming a shell around a core material are separated from the aqueous reaction medium, for instance, by spray drying to obtain a dry encapsulated toner.

The dried encapsulated toner particles are preferably heated to further improve their powder characteristics. The temperature for heating the dried encapsulated toner particles preferably ranges from 50° to 300° C., and more preferably ranges from 80° to 150° C. The period required for performing the heating varies with the heating temperature, the nature of the binder, etc. Generally, the period ranges from 10 minutes to 48 hours, and preferably ranges from 2 to 24 hours.

There is no limitation on the means employed for performing the heating procedure. Examples of the heating means include an electric furnace, a muffle furnace, a hot plate, an electric drying oven, a fluid bed drying apparatus, and an infrared drying apparatus.

The resinous shell of the encapsulated toner of the invention can be provided with a charge-controlling agent such as a metal-containing dye or nigrosine, a flow improver such as hydrophobic silica, or other additive. These additive can be added to the shell of the encapsulated toner in an optional stage such as in the course of formation of the shell or after separating and drying the encapsulated toner.

The present invention will be illustrated by the following examples which are by no means intended to introduce any restriction into the invention.

EXAMPLE 1

40 wt.% of polyisobutyl methacrylate was dissolved a liquid mixture consisting of 1-dimethyl-phenyl-1-phenylethane and ISOPAR H (trade name of Exxon Chemicals, an aliphatic saturated hydrocarbon mixture having a boiling range of 174° to 189° C.) in a ratio of 6:5 by weight. Further, 0.02 g. of the aforementioned surface active polymer (1) was dissolved in the resulting mixture. 7 g. of magnetite particles (trade name: EPT-1000, available from Toda Industry Co., Ltd., Japan this also serves as colorant) was kneaded and dispersed in 9 g. of the resulting solution to prepare a dispersion. 6 g. of an ethyl acetate solution containing 1.6 g. of toluylene diisocyanate-hexanetriol (3:1 molar ratio) adduct (shell material component) was mixed with the above dispersion to obtain a primary solution.

Independently, 40 g. of 5% aqueous solution of methylcellulose (degree of methoxy substitution: 1.8, average molecular weight: 15,000) was prepared to give a second solution.

The second solution was chilled to 10° C., and the primary solution was added dropwise thereto. The resulting mixture was stirred by using a high-speed homogenizer to obtain an oil-in-water type emulsion wherein the average size of oil droplet was about 14 μm.

3 g. of a 10% aqueous solution of diethylenetriamine was slowly added dropwise to the above emulsion. The mixture was then adjusted to pH 10 and stirred at 60° C. for 3 hours to complete an encapsulation reaction. A water washing operation comprising centrifuging the resulting microcapsule dispersion at 2,000 rpm, removing the resulting supernatant liquid, adding washing water and again centrifuging dispersion was carried out. This operation was repeated as much as 10 times to remove methylcellulose from the liquid phase.

The resulting dispersion was spray-dried in a spray drier under conditions such that the inlet temperature was 170° C., the outlet temperature was 110° C. and the spray pressure was 24 Kg./cm$^2$. There was obtained a powdery encapsulated toner.

The encapsulated toner was a powder which was highly dried and had good flow characteristics. Microscopic examination revealed that most of the toner particles existed independently and no bulky agglomerated particles were formed.

The image characteristics of the obtained encapsulated toner was evaluated in the following manner.

An electrostatic latent image formed by conventional electrostatography was developed with the above encapsulated toner to give a toner image which was then transferred onto a paper sheet to give a visible image. The paper sheet carrying the visible image was treated with a pressing roller under a pressure of 150 Kg./cm$^2$. There was obtained a visible image with good fixability.

EXAMPLE 2

The procedure of EXAMPLE 1 was repeated except that the aforementioned surface active polymer (2) was used in place of the surface active polymer (1) in the primary solution. The encapsulation, water washing and spray drying were carried out to obtain a powdery encapsulated toner.

In a similar manner to that described in EXAMPLE 1, an image was developed with the toner, transferred onto a paper sheet and fixed under pressure. There was obtained a visible image with good fixability.

EXAMPLE 3

The procedure of EXAMPLE 1 was repeated except that the aforementioned surface active polymer (3) was used in place of the surface active polymer (1) in the primary solution. The encapsulation, water washing and spray drying were carried out to obtain a powdery encapsulated toner.

In a similar manner to that described in EXAMPLE 1, an image was developed with the toner, transferred onto a paper sheet and fixed under pressure. There was obtained a visible image with good fixability.

EXAMPLE 4

The procedure of EXAMPLE 1 was repeated except that the aforementioned surface active polymer (15) was used in place of the surface active polymer (1) in the primary solution. The encapsulation, water washing and spray drying were carried out to obtain a powdery encapsulated toner.

In a similar manner to that described in EXAMPLE 1, an image was developed with the toner, transferred onto a paper sheet and fixed under pressure. There was obtained a visible image with good fixability.

COMPARISON EXAMPLE 1

The procedure of Example 1 was repeated except that the use of the surface active polymer was omitted. The encapsulation, water washing and spray drying were carried out to obtain a powdery encapsulated toner.

In a similar manner to that described in EXAMPLE 1, an image was developed with the toner, transferred onto a paper sheet and fixed under pressure. There was obtained a visible image with good fixability.

EVALUATION OF IMAGE-FORMING CHARACTERISTICS

The density of each of the visible image transferred and fixed onto the paper sheet was examined by measuring the solid black portion of each of the transferred visible images obtained in EXAMPLES and COMPARISON EXAMPLE with Macbeth Reflection Densitometer. Fog was judged by examining the staining in white portion with the naked eye. The results are shown in Table 1.

TABLE 1

| Fixed Visible Image | Reflection Density | Fog |
|---|---|---|
| Example 1 | 1.20 | None |
| 2 | 1.18 | None |
| 3 | 1.23 | None |
| 4 | 1.23 | None |
| Com. Example 1 | 1.09 | Some |

It is apparent from Table 1 that when the surface active polymer of the present invention is present in the core material, the reflection density is high and fog is reduced as compared with the case where no surface active polymer is used. Although the reason why such effects can be observed is not clarified as yet, it is thought to be due to the fact that the dispersibility of the colorant in the core material is improved by the action of the surface active polymer, agglomeration is prevented and more uniform dispersion is made possible so that covering is improved and the reflection density is made high. Reduction in the fog is thought to be due to the fact that the colorant is incorporated in an approximately equal proportion in the toner particles having different particle sizes.

What is claimed is:

1. An encapsulated toner comprising a shell and a core material comprising a colorant, a binder and 0.1 to 2% by weight of a surface active polymer containing at least 5 mol % of a unit having the formula (I):

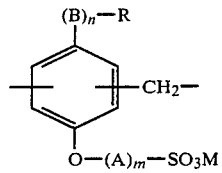

(I)

wherein R is an aliphatic hydrocarbon group having from 4 to 22 carbon atoms, A is a divalent aliphatic group having from 1 to 50 carbon atoms, B is —O— or —NH—, M is a cation or a cationic radical capable of forming a salt with a sulfonic acid, and m and n are independently 0 or 1.

2. The encapsulated toner as claimed in claim 1, in which said shell is made of at least one resin selected from the group consisting of polyurea, polyurethane, polyamide and polyester.

3. The encapsulated toner as claimed in claim 2, in which said shell is composed of a layer comprising a polyurea resin and/or a polyurethane resin and a polyamide resin.

4. The encapsulated toner as claimed in claim 1, in which said core material contains magnetizable particles.

5. A process for preparing an encapsulated toner which comprises forming a shell around a core material comprising a colorant and a binder in an aqueous medium to produce microcapsules, separating the microcapsules from the aqueous medium and drying them, said core material being dispersed in the form of oil-droplets in said aqueous medium, characterized in that said core material contains 0.1 to 2% by weight of a surface active polymer containing at least 5 mol % of a unit having the formula (I):

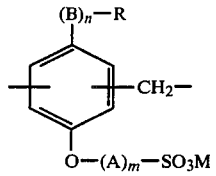

(I)

wherein R is an aliphatic hydrocarbon group having from 4 to 22 carbon atoms, A is a divalent aliphatic group having from 1 to 50 carbon atoms, B is —O— or —NH—, M is a cation or a cationic radical capable of forming a salt with a sulfonic acid, and m and n are independently 0 or 1.

6. The process for preparing an encapsulated toner as claimed in claim 5, in which said shell is formed of at least one resin selected from the group consisting of polyurea, polyurethane, polyamide and polyester.

7. The process for preparing an encapsulated toner as claimed in claim 6, in which said shell is composed of a layer comprising a polyurea and/or a polyurethane and a polyamide.

8. The process for preparing an encapsulated toner as claimed in claim 5, in which said core material contains magnetic particles.

* * * * *